US009144836B2

(12) United States Patent
Tsai et al.

(10) Patent No.: US 9,144,836 B2
(45) Date of Patent: Sep. 29, 2015

(54) FEEDING DEVICE

(71) Applicant: HIWIN TECHNOLOGIES CORP., Taichung (TW)

(72) Inventors: Chien-Hsiang Tsai, Taichung (TW); Yao-Jen Chang, Taichung (TW); Chao-Yu Lee, Taichung (TW)

(73) Assignee: HIWIN TECHNOLOGIES CORP., Taichung (TW)

( * ) Notice: Subject to any disclaimer, the term of this patent is extended or adjusted under 35 U.S.C. 154(b) by 374 days.

(21) Appl. No.: 13/667,932

(22) Filed: Nov. 2, 2012

(65) Prior Publication Data

US 2013/0313302 A1 Nov. 28, 2013

(51) Int. Cl.

| | |
|---|---|
| ***B65H 51/06*** | (2006.01) |
| ***B21F 23/00*** | (2006.01) |
| ***B21D 43/00*** | (2006.01) |

(52) U.S. Cl.

CPC ..... *B21F 23/005* (2013.01); *B21D 43/006* (2013.01); *B21F 23/002* (2013.01); *B65H 51/06* (2013.01)

(58) Field of Classification Search

CPC ..... B65H 51/06; B21F 23/00; B21F 23/002; B21F 23/005; B21D 43/006; B23Q 7/00; B27B 25/02

USPC ..... 226/153, 155, 173

See application file for complete search history.

(56) References Cited

U.S. PATENT DOCUMENTS

| | | | | | |
|---|---|---|---|---|---|
| 3,203,608 | A | * | 8/1965 | Mogolis | 226/124 |
| 3,599,852 | A | * | 8/1971 | Eichenhofer | 226/155 |
| 3,780,924 | A | * | 12/1973 | Eichenhofer | 226/155 |
| 4,235,362 | A | * | 11/1980 | Hubenko | 226/181 |
| 4,300,276 | A | * | 11/1981 | Davis | 29/234 |
| 5,158,781 | A | * | 10/1992 | Gatto | 425/135 |

FOREIGN PATENT DOCUMENTS

| | | |
|---|---|---|
| TW | M273402 | 8/2005 |
| TW | M336251 | 7/2008 |

* cited by examiner

*Primary Examiner* — William E Dondero

(74) *Attorney, Agent, or Firm* — Muncy, Geissler, Olds & Lowe, P.C.

(57) ABSTRACT

A feeding device includes a fixing base. A motor is fixed to the fixing base. The motor has an output axle. A transmission axle is fixedly connected to the output axle. The feeding device further includes a feeding block having a side fixedly connected to the transmission axle. The feeding block has a feeding notch. The feeding notch is formed around the transmission axle circumferentially. Hence, once a slender material enters the rotational space of the feeding block, the motor drives the feeding block to rotate, whereas the slender material is pressed by the feeding notch of the feeding block and sent out as a result of the continuous rotation of the feeding block. Hence, the feeding device not only enables continuous material conveyance but also allows the slender material to be conveyed smoothly even when the slender material is slightly bent or deformed.

9 Claims, 11 Drawing Sheets

FEEDING DEVICE

BACKGROUND OF THE INVENTION

1. Technical Field

The present invention relates to devices for transporting materials, and more particularly, to a feeding device for moving slender materials.

2. Description of Related Art

The feeding process performed by a conventional slender material feeding device usually involves lowering one end of the slender material and convey the material to an intended position. Both Taiwan Patent M336251 (hereinafter referred to as "citation 1") and Taiwan Patent M273402 (hereinafter referred to as "citation 2") disclose a conventional feeding device. Citation 1 discloses a rod-less cylinder linked to a sliding base of a linear rail through an adjustable connection plate so as to lower the slender material to an intended position. However, the feeding device of citation 1 is not only slender but also overly bulky in order to contain the slender material. Furthermore, it is likely that the feeding device of citation 1 cannot convey a material smoothly, if the material is slightly bent or deformed. Citation 2 discloses pushing a slender material by windingly conveying a flexible steel rod with a rotary device so as to reduce the required volume thereof and save space. However, the flexible steel rod is likely to entangle itself when it is windingly retracted; hence, not only is there a limitation of the length of the steel rod, but there is also a limitation of the length of the material being conveyed. In addition, like citation 1, citation 2 has another disadvantage, that is, it is likely that the feeding device of citation 2 cannot convey a material smoothly, if the material is slightly bent or deformed.

In view of this, to meet the needs of the R&D of feeding devices, it is imperative to design a feeding device not only capable of conveying a slender material continuously but also unsusceptible to a slight bend or deformation of the slender material.

SUMMARY OF THE INVENTION

It is an objective of the present invention to provide a feeding device free from a limitation of the length of a slender material, capable of conveying the slender material continuously, and unsusceptible to a slight bend or deformation of the slender material.

In order to achieve the above and other objectives, the present invention provides a feeding device, comprising: a fixing base; a motor fixed to the fixing base and having an output axle; a transmission axle fixedly connected to the output axle; and a feeding block having a side fixedly connected to the transmission axle. The feeding block has a feeding notch. The feeding notch is formed around the transmission axle circumferentially.

Therefore, once the slender material enters the rotational space of the feeding block, the motor drives the feeding block to rotate, whereas the slender material is pressed by the feeding notch of the feeding block and sent out as a result of the continuous rotation of the feeding block. Hence, the feeding device of the present invention not only enables continuous material conveyance but also eliminates any limitation of the length of the slender material. In addition, in the situation where the slender material is slightly bent or deformed, the feeding block presses against the slender material, and thus the feeding block is in contact with the slender material precisely to thereby drive the slender material to move, such that the feeding block can convey the slender material smoothly.

BRIEF DESCRIPTION OF THE SEVERAL VIEWS OF THE DRAWINGS

Objectives, features, and advantages of the present invention are hereunder illustrated with preferred embodiments in conjunction with the accompanying drawings, in which.

DETAILED DESCRIPTION OF THE EMBODIMENTS OF THE INVENTION

Figure 1:
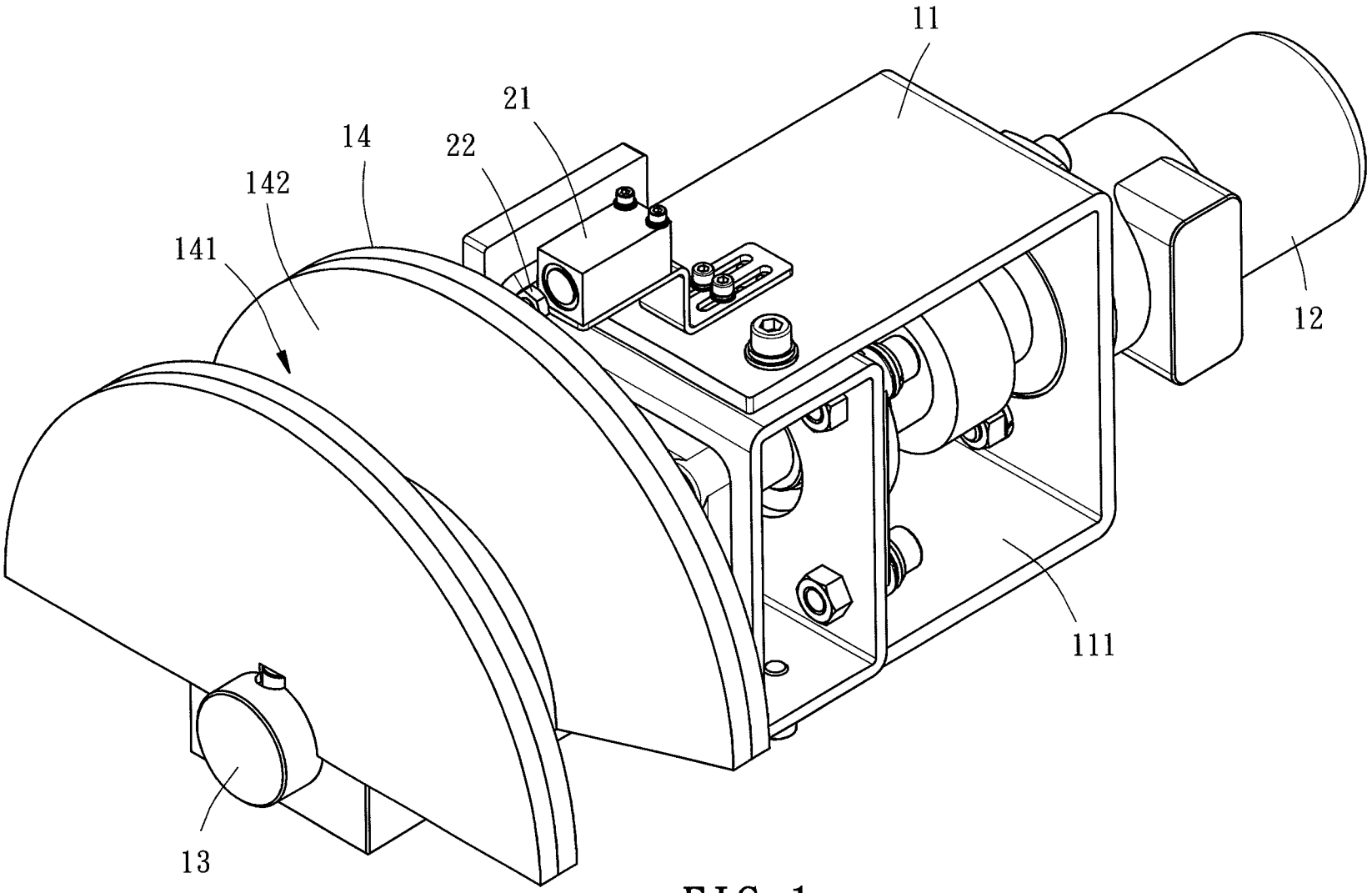
FIG. 1 is a perspective view of a feeding device according to the first preferred embodiment of the present invention.
Figure 2:
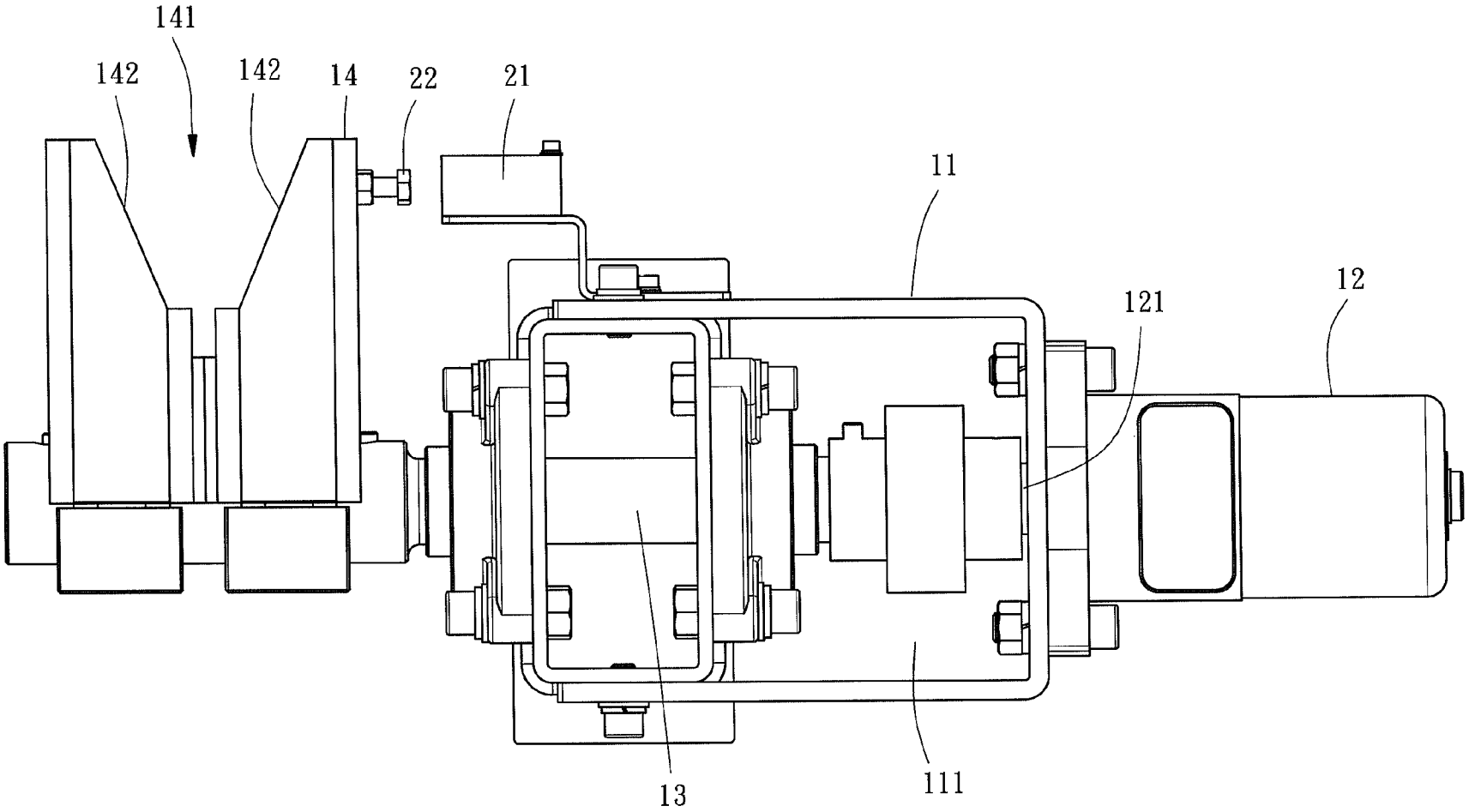
FIG. 2 is a front view of the feeding device according to the first preferred embodiment of the present invention.
Figure 3:
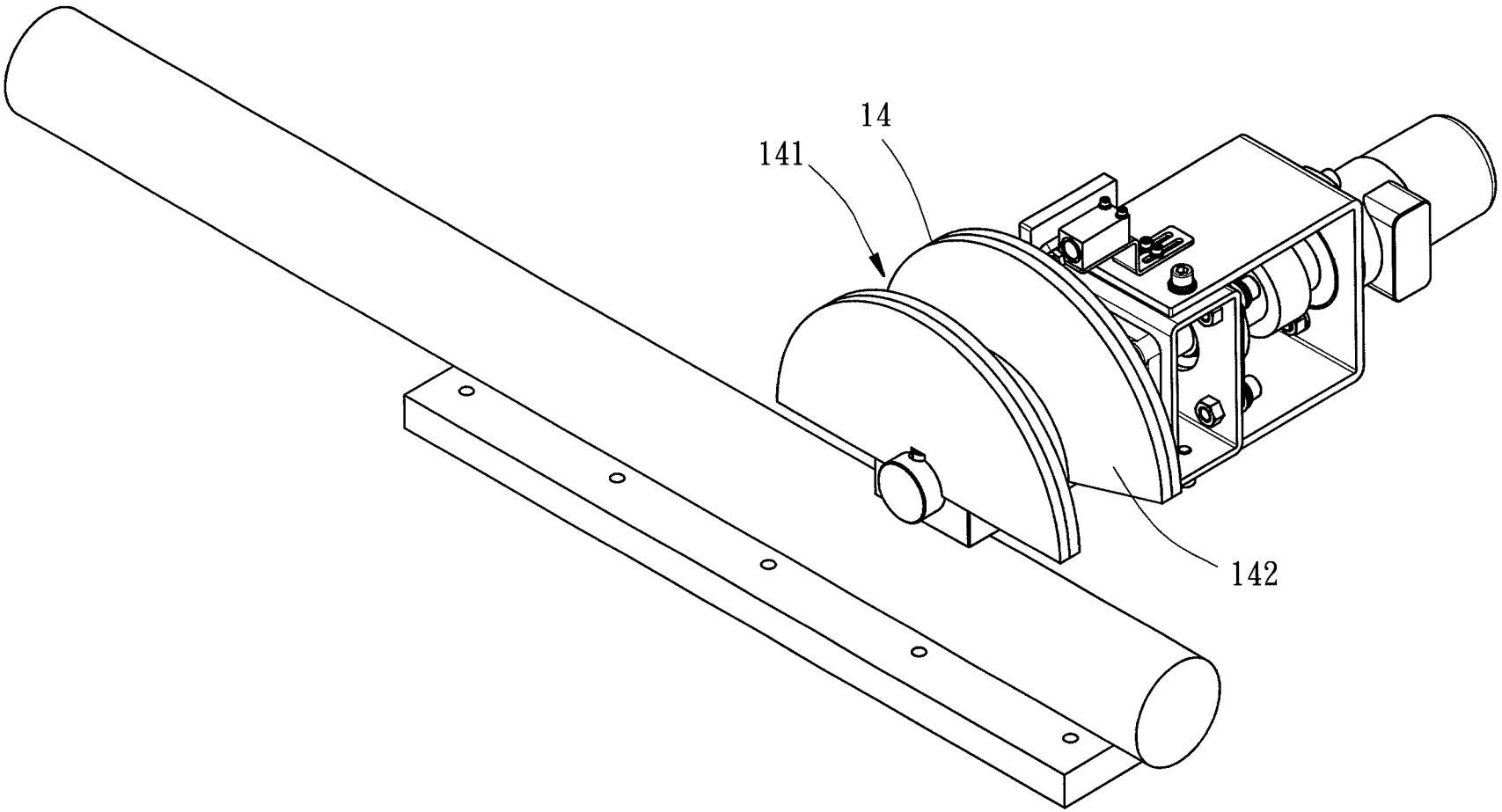
FIG. 3 is a schematic view of operation of the feeding device according to the first preferred embodiment of the present invention, showing how to convey a slender material.
Figure 4:
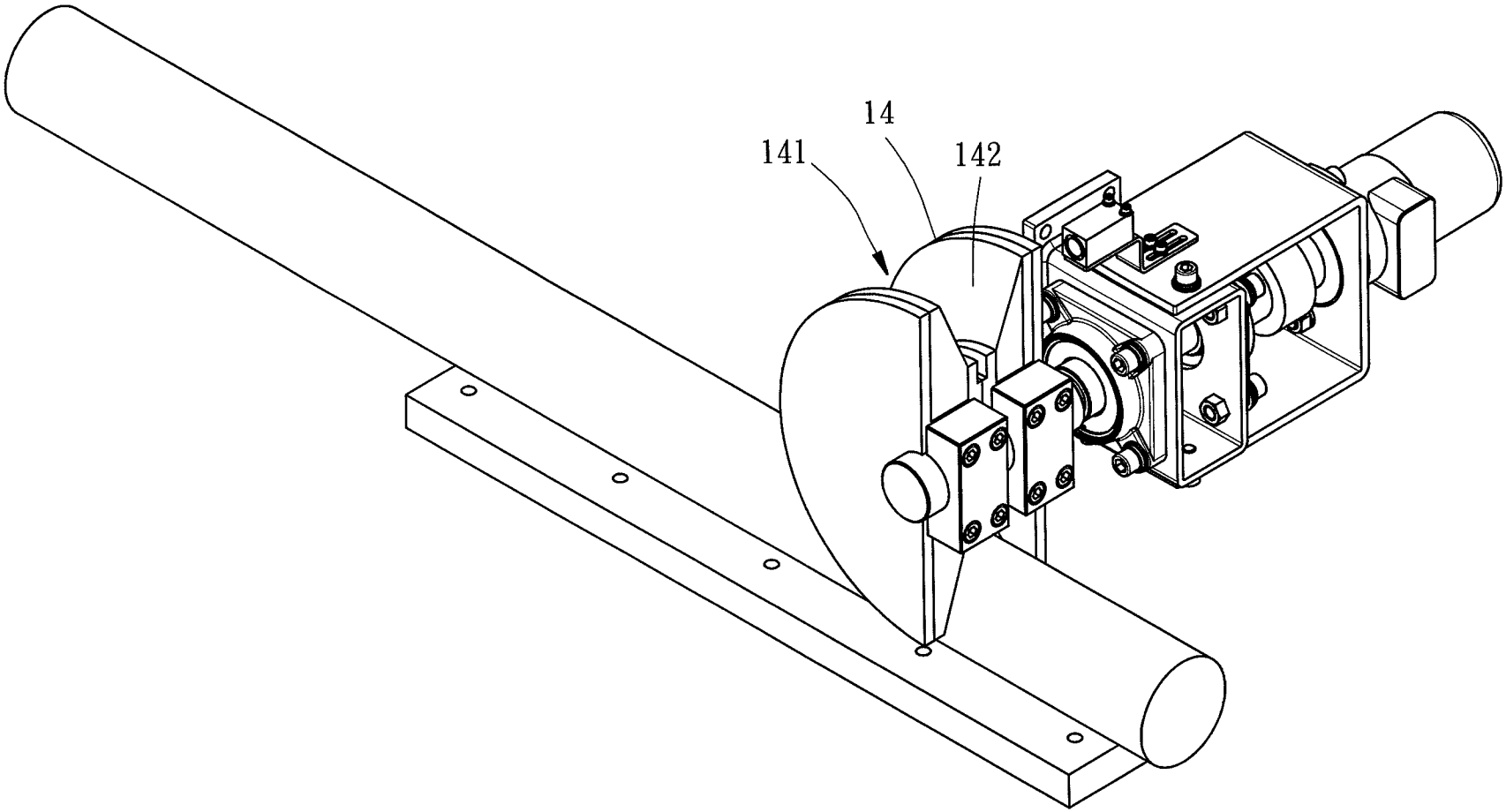
FIG. 4 is a schematic view of operation of the feeding device according to the first preferred embodiment of the present invention, showing how to convey the slender material.
Figure 5:
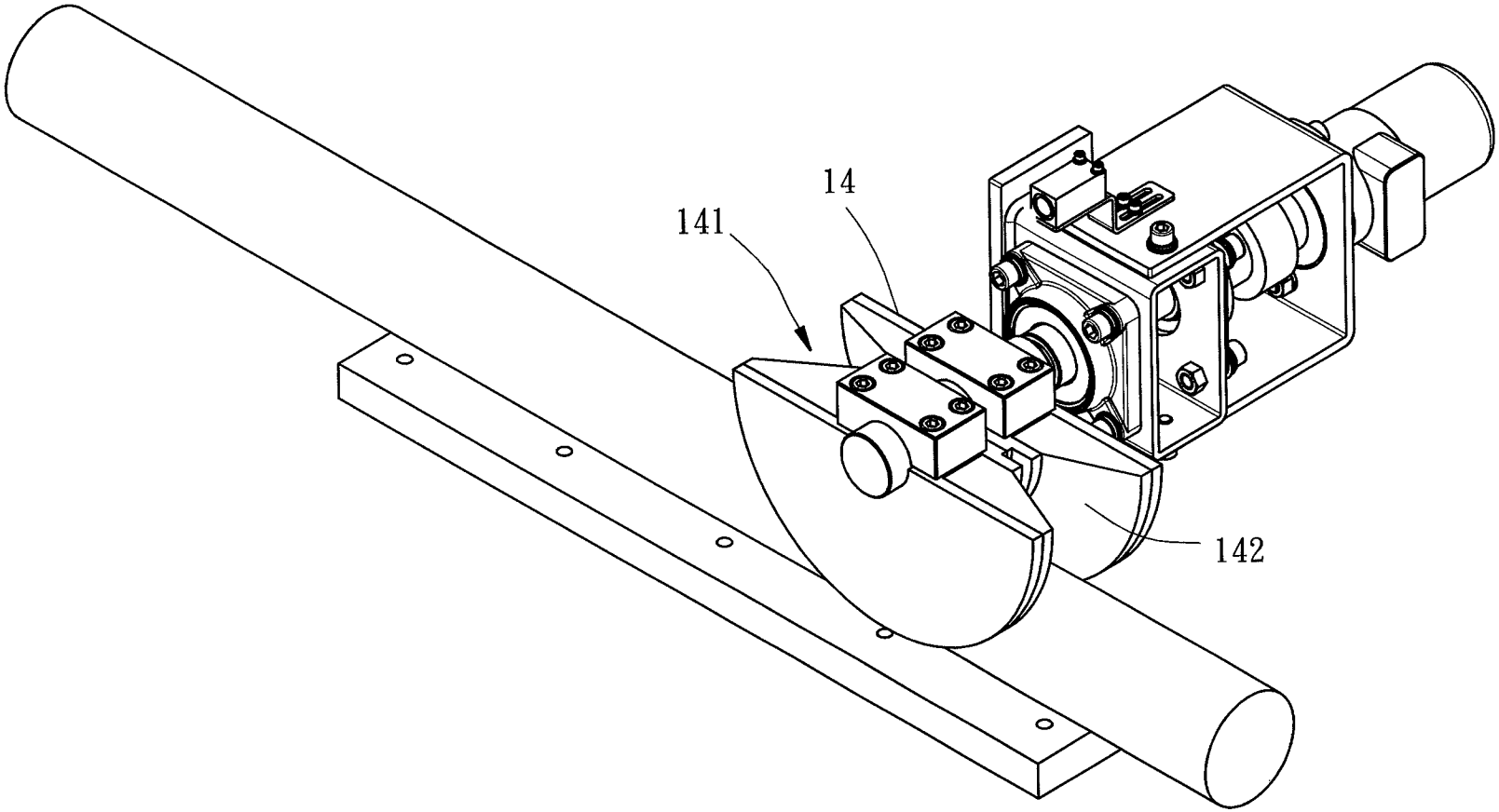
FIG. 5 is a schematic view of operation of the feeding device according to the first preferred embodiment of the present invention, showing how to convey the slender material.
Figure 6:
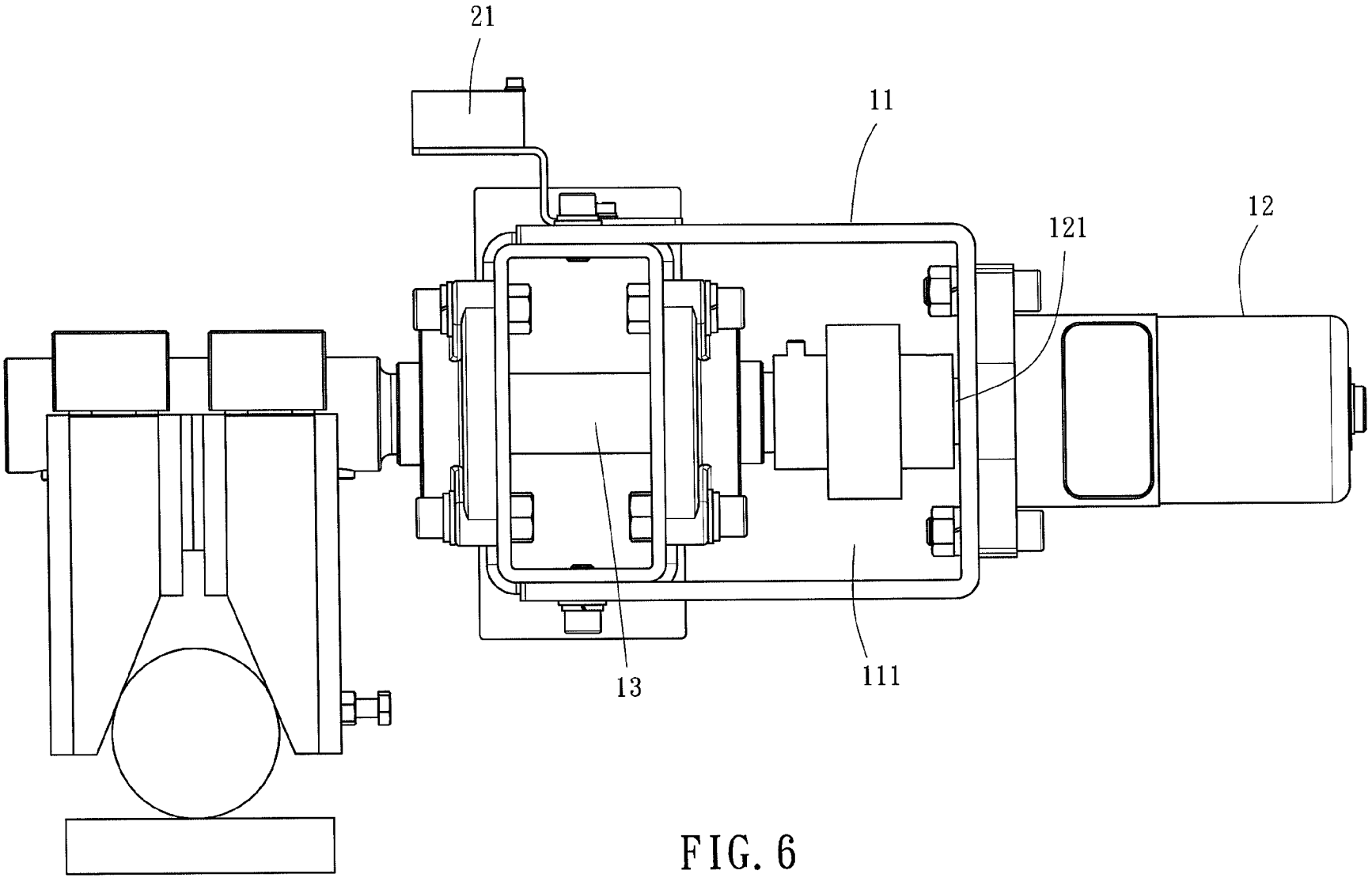
FIG. 6 is a front view of operation of the feeding device according to the first preferred embodiment of the present invention, showing how to convey the slender material.

Referring to FIG. 1 and FIG. 2, in the first preferred embodiment of the present invention, a feeding device essentially comprises a fixing base 11, a motor 12, a transmission axle 13, and a feeding block 14.

The motor 12 is fixed to the fixing base 11. The motor 12 has an output axle 121.

The transmission axle 13 is fixedly connected to the output axle 121.

One side of the feeding block 14 is fixedly connected to the transmission axle 13. The feeding block 14 has a feeding notch 141. The feeding notch 141 is formed around the transmission axle 13 circumferentially.

In the first preferred embodiment, the feeding notch 141 is formed at the feeding block 14 in a manner that the feeding notch 141 is equidistant from the transmission axle 13 radially. Hence, the feeding notch 141 of the feeding block 14 is in contact with the slender material continuously to render it easy to convey the slender material of an equal cross-sectional area. In fact, if the cross-sectional area of the slender material features a periodic change, the feeding notch 141 can be formed at the feeding block 14 in a manner that the feeding notch 141 is not equidistant from the transmission axle 13 radially in response to a change in the cross-sectional area of the slender material. Still, its objective is to enable the feeding notch 141 of the feeding block 14 to be in contact with the slender material continuously and thereby facilitate conveyance of the slender material.

Furthermore, the feeding notch 141 of the feeding block 14 has a plurality of oblique surfaces 142. The oblique surfaces 142 face each other and spread outward gradually. Hence, the feeding notch 141 of the feeding block 14 presses against the slender material by following a tapered course of contact therebetween, so as to enable smooth conveyance of the slender material and ensure that the slender material will be conveyed to an intended position.

Referring to FIG. 3 through FIG. 6, in the first preferred embodiment of the present invention, once the slender material enters the rotational space of the feeding block 14, the motor 12 drives the feeding block 14 to rotate, whereas the slender material is pressed by the feeding notch 141 of the feeding block 14 and sent out as a result of the continuous rotation of the feeding block 14. Hence, the first preferred embodiment of the present invention not only enables continuous material conveyance but also eliminates any limitation of the length of the slender material.

Figure 7:
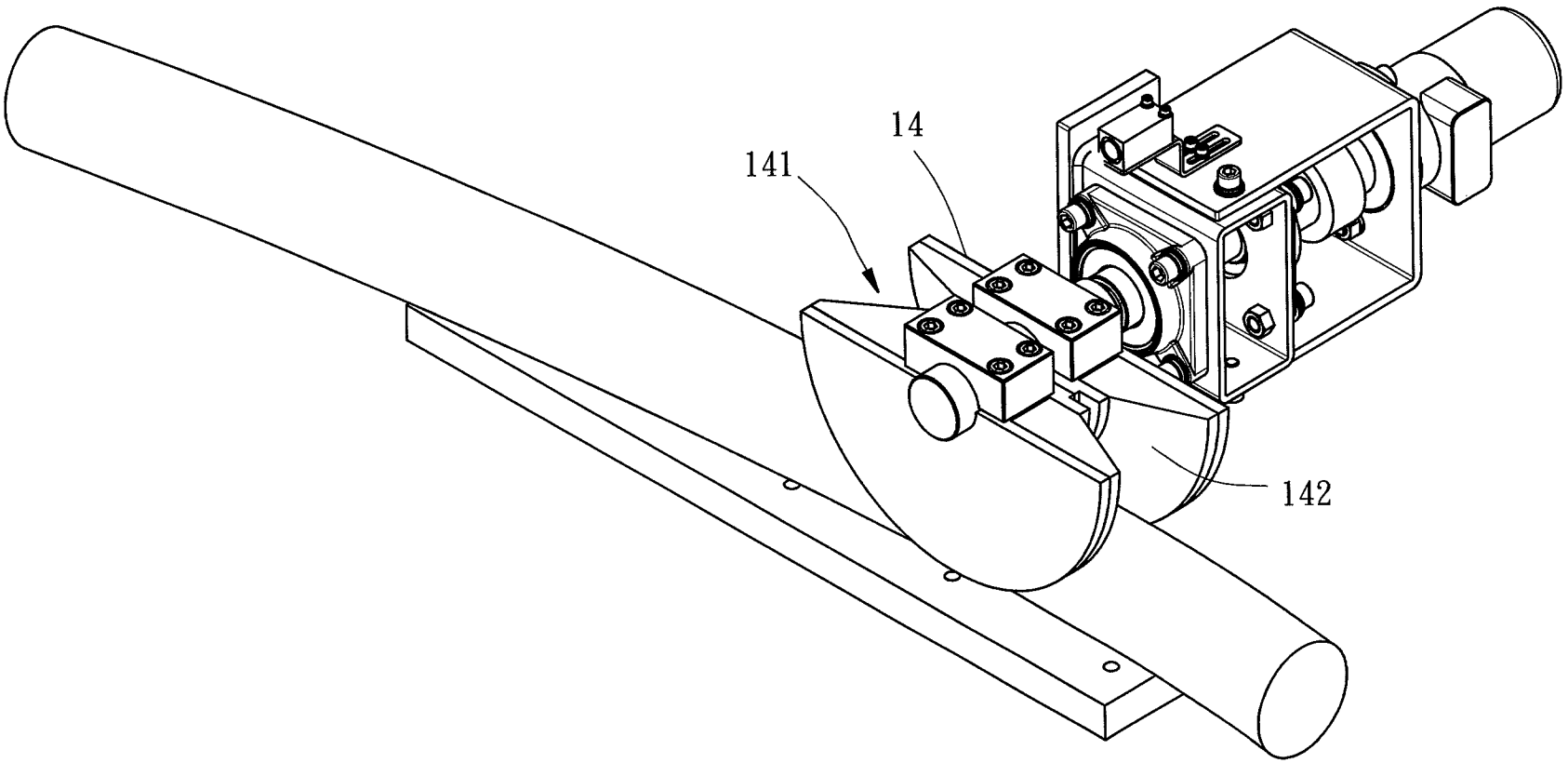
FIG. 7 is a schematic view of operation of the feeding device according to the first preferred embodiment of the present invention, showing how to convey the slender material.

Referring to FIG. 7, in the situation where the slender material is slightly bent or deformed, the feeding block 14 presses against a portion of the slender material and thus is in contact with the slender material to thereby drive the slender material to move, such that the feeding block 14 can convey the slender material smoothly.

Figure 8:
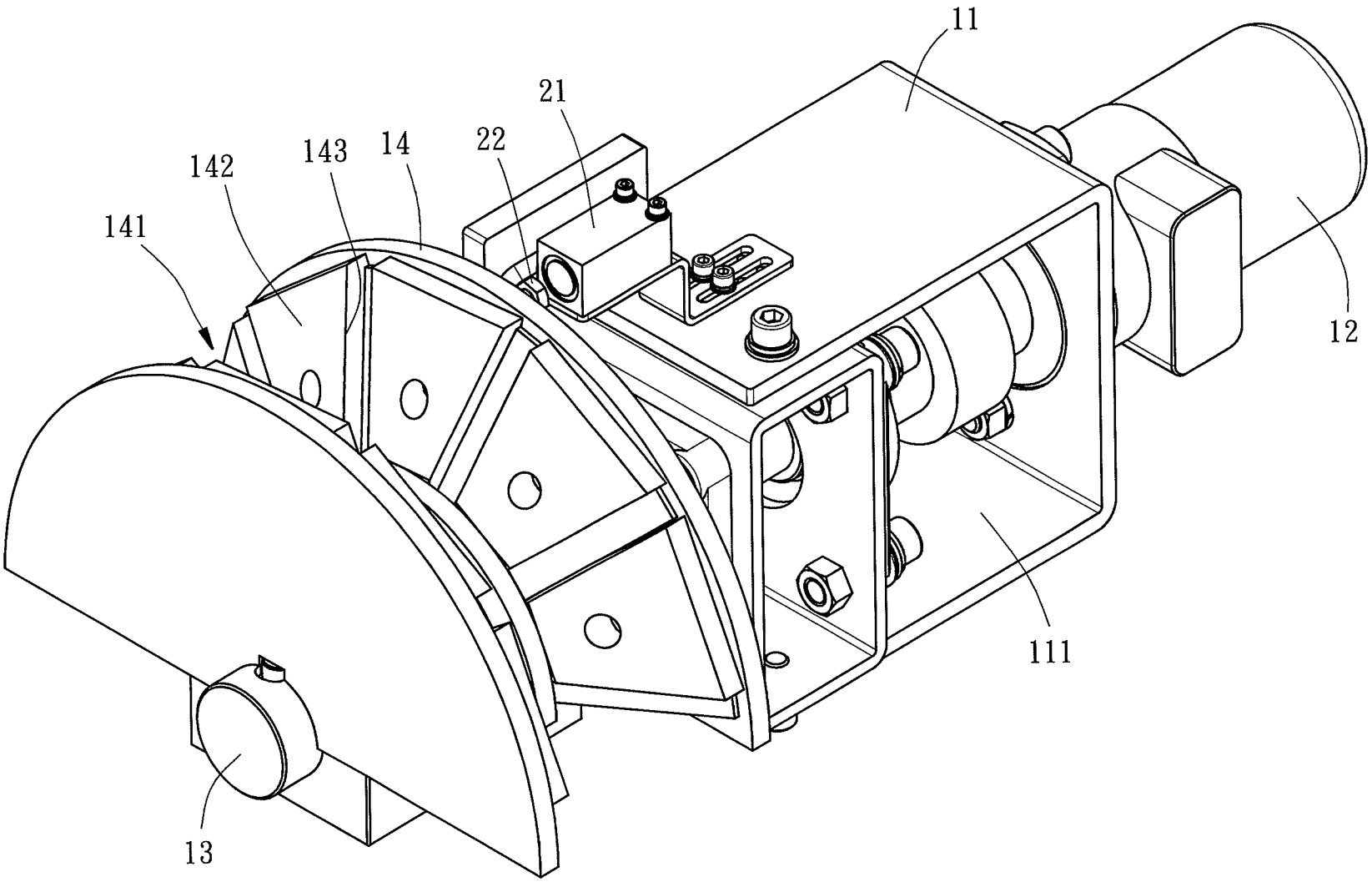
FIG. 8 is a perspective view of the feeding device according to the second preferred embodiment of the present invention.
Figure 9:
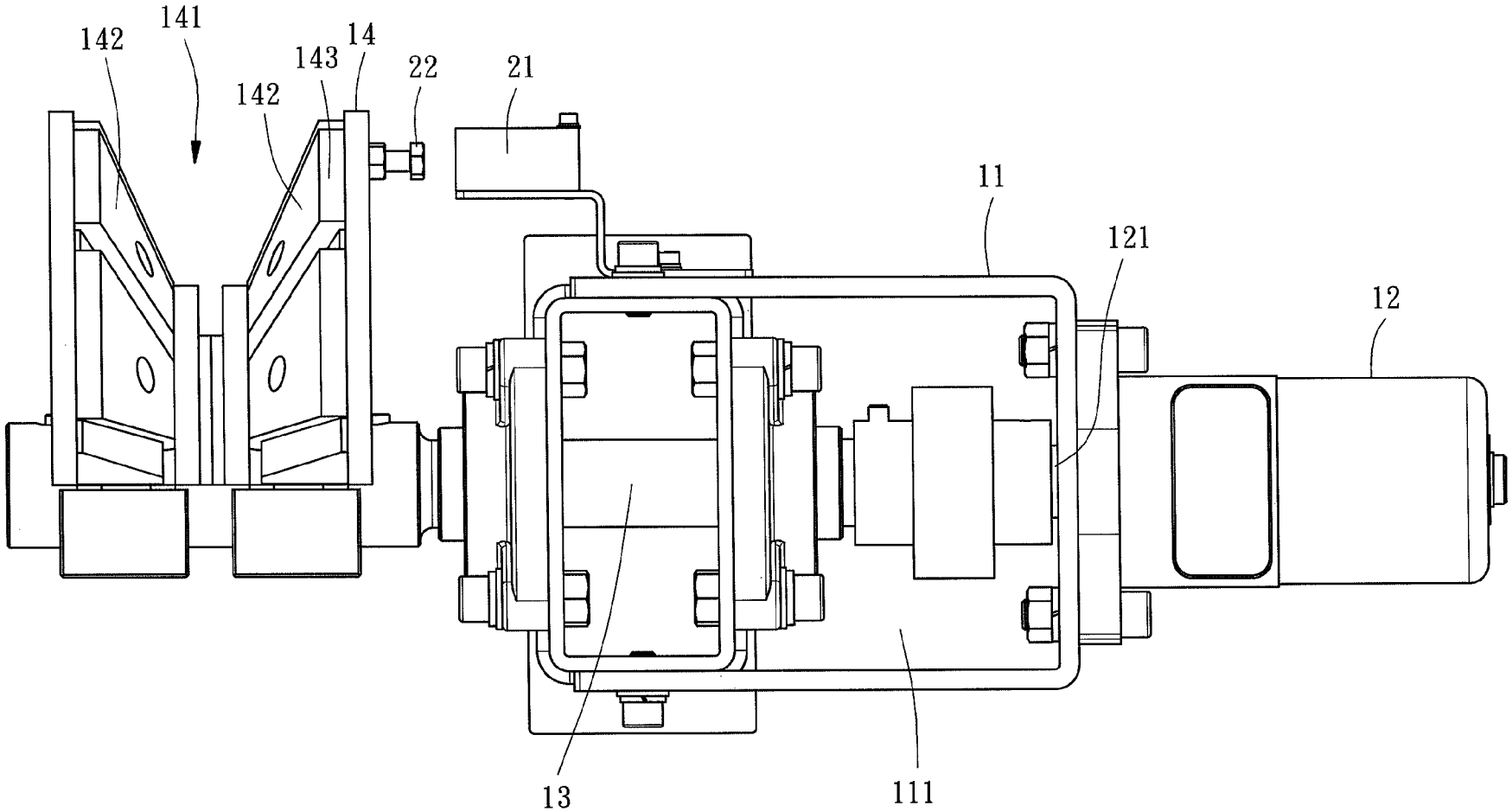
FIG. 9 is a front view of the feeding device according to the second preferred embodiment of the present invention.

Referring to FIG. 8 and FIG. 9, the second preferred embodiment of the present invention is different from the first preferred embodiment of the present invention in that, in the second preferred embodiment, a plurality of driving blocks 143 is arranged in pair, disposed in the feeding notch 141, fixed to the feeding block 14, and made of a flexible material. The driving blocks 143 have the oblique surfaces 142. The oblique surfaces 142 are arranged in pair inside the feeding notch 141 to face each other and spread outward gradually. In the second preferred embodiment of the present invention, the driving blocks 143 are made of a flexible material and thus provide larger allowance of deformation of the slender material than they do in the first preferred embodiment of the present invention. In case the oblique surfaces 142 get damaged, only the driving blocks 143 of the damaged ones of the oblique surfaces 142 will have to be changed, thereby cutting related costs and ensuring convenience.

Referring to FIG. 1, FIG. 2, FIG. 8, and FIG. 9, in the first preferred embodiment and the second preferred embodiment, the fixing base 11 has therein a chamber 111. The output axle 121 of the motor 12 protrudes into the chamber 111. The transmission axle 13 protrudes into the chamber 111 to thereby fixedly connect to the output axle 121. Therefore, with the fixing base 11 protecting the output axle 121 of the motor 12 and the transmission axle 13, the likelihood of a worker being wrongly touched and a foreign body intruding into or being windingly taken into the feeding device is reduced.

Furthermore, in the first preferred embodiment and the second preferred embodiment, to detect the position of the feeding block 14 relative to the fixing base 11, the feeding device of the present invention further has a sensor 21 and a sensing body 22. The sensor 21 is fixedly connected to the fixing base 11. The sensing body 22 is fixedly connected to the feeding block 14 and moves together with the feeding block 14 to pass the sensor 21. The sensor 21 generates a signal as soon as the sensing body 22 approaches the sensor 21, thereby detecting the position of the feeding block 14 relative to the fixing base 11 so as to control the feeding block 14.

Figure 10:
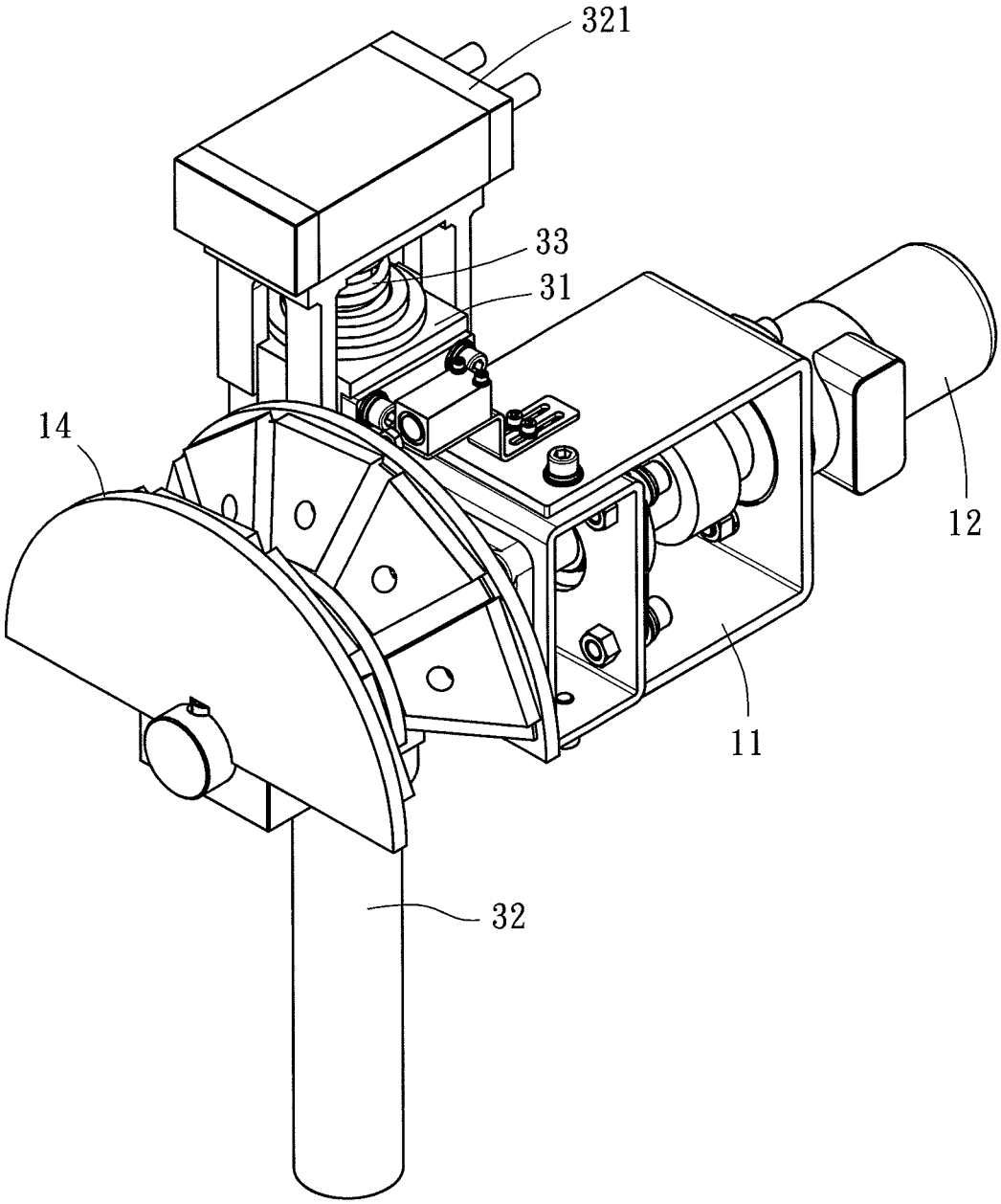
FIG. 10 is a perspective view of the feeding device according to the third preferred embodiment of the present invention.
Figure 11:
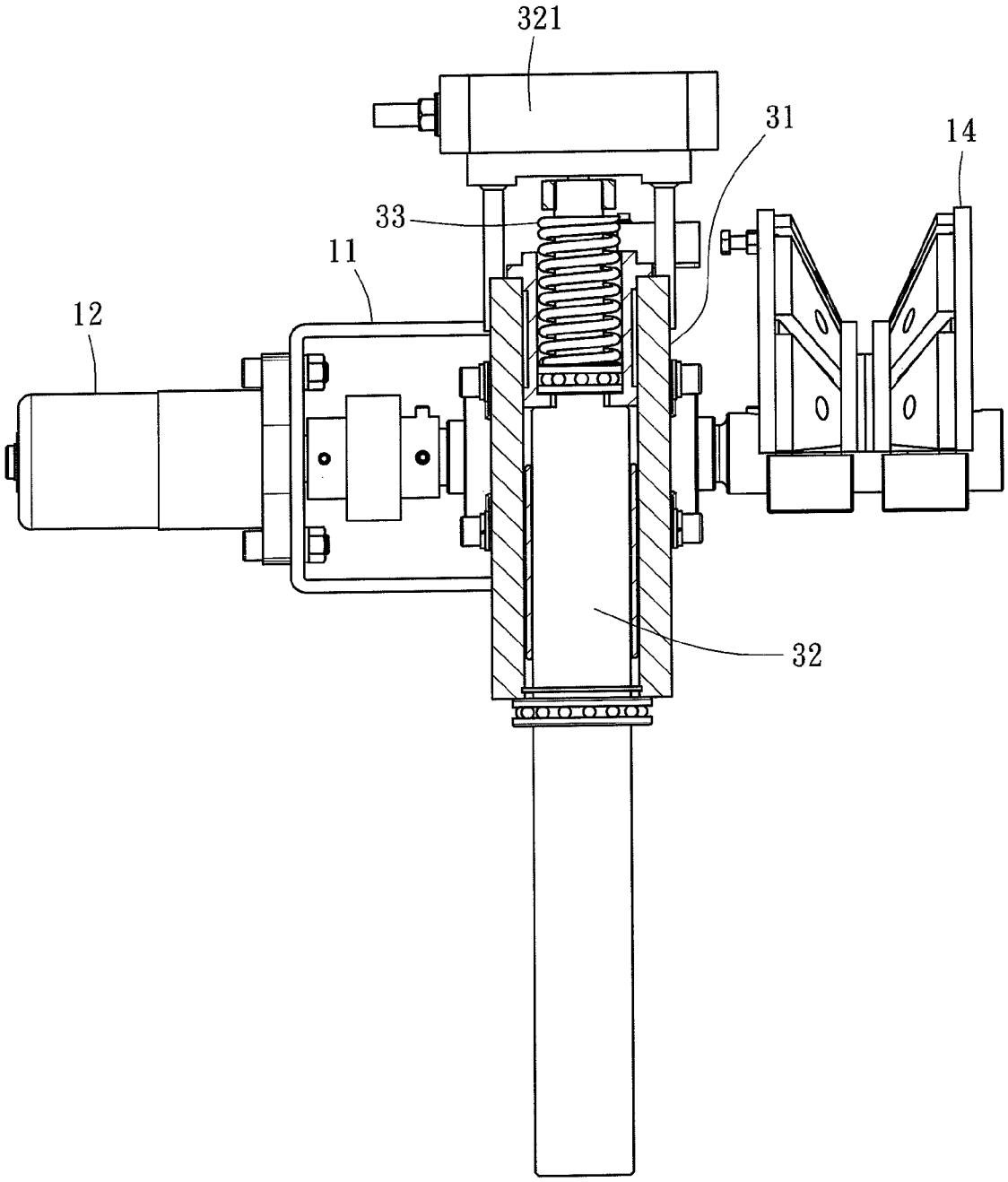
FIG. 11 is a schematic cross-sectional view of the feeding device according to the third preferred embodiment of the present invention.

Referring to FIG. 10 and FIG. 11, the third preferred embodiment of the present invention is different from the first preferred embodiment and the second preferred embodiment in that, in the third embodiment, the feeding device further comprises a sliding block 31. In this regard, the sliding block 31 is added to the first preferred embodiment for the sake of illustration. The sliding block 31 slides along a rail 32. For example, the sliding block 31 is disposed around the rail 32, or the rail 32 contains the sliding block 31. The fixing base 11 is fixedly connected to the sliding block 31. Hence, even if the slender material changes in its cross-sectional area or deforms, the feeding block 14 can move vertically together with the slender material and thereby press against the slender material precisely to convey the slender material. Furthermore, in the third preferred embodiment, a stopping member 321 is disposed at one end of the rail 32, wherein a resilient body 33 is disposed between the sliding block 31 and the stopping member 321. In the third preferred embodiment, the resilient body 33 is exemplified by a compression spring. Once the sliding block 31 moves toward the stopping member 321, the resilient body 33 will respond thereto by exerting a counteraction force upon the sliding block 31 to thereby cause the feeding block 14 to press against the slender material harder than it does in the first preferred embodiment and the second preferred embodiment.

According to the above preferred embodiments, the feeding device of the present invention has benefits and effects as follows:

1. Once the slender material enters the rotational space of the feeding block 14, the feeding block 14 will rotate continuously to convey the slender material, thereby eliminating any limitation of the length of the slender material.

2. In the situation where the slender material is slightly bent or deformed, the feeding block 14 presses against a portion of the slender material continuously, and thus the feeding block 14 is in contact with the slender material precisely to thereby drive the slender material to move, such that the feeding block 14 can convey the slender material smoothly.

What is claimed is:

1. A feeding device, comprising:

a fixing base;

a motor fixed to the fixing base and having an output axle;

a transmission axle fixedly connected to the output axle;

a feeding block having a side fixedly connected to the transmission axle, a first semicircular wall, a second semicircular wall spacedly facing the first semicircular wall, and a feeding notch formed around the transmission axle circumferentially between the first and second semicircular walls; and a plurality of driving blocks pairedly fixed to the first and second semicircular walls of the feeding block, disposed in the feeding notch, and made of a flexible material.

2. The feeding device of claim 1, wherein the feeding notch is formed at the feeding block in a manner that the feeding notch is equidistant from the transmission axle radially.

3. The feeding device of claim 1, wherein the feeding notch of the feeding block has a plurality of oblique surfaces, the oblique surfaces facing each other and spreading outward gradually.

4. The feeding device of claim 1, wherein the driving blocks have an oblique surface each, the oblique surfaces being arranged in pair inside the feeding notch to face each other and spread outward gradually.

5. The feeding device of claim 1, wherein the fixing base has therein a chamber, and the output axle of the motor protrudes into the chamber, wherein the transmission axle protrudes into the chamber to thereby fixedly connect to the output axle.

6. The feeding device of claim 1, further comprising a sensor fixedly connected to the fixing base and a sensing body fixedly connected to the feeding block to thereby move together with the feeding block and pass the sensor.

7. The feeding device of claim 1, wherein a sliding block slides along a rail, and the fixing base is fixedly connected to the sliding block.

8. The feeding device of claim 7, wherein a stopping member is disposed at an end of the rail, and a resilient body is disposed between the sliding block and the stopping member.

9. The feeding device of claim 8, wherein the resilient body is a compression spring.

* * * * *